US007680582B2

(12) United States Patent
Ishida et al.

(10) Patent No.: US 7,680,582 B2
(45) Date of Patent: Mar. 16, 2010

(54) IDLING ROTATION SPEED CONTROL APPARATUS

(75) Inventors: Yasuhiko Ishida, Kobe (JP); Hitoshi Sako, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 23 days.

(21) Appl. No.: 12/208,661

(22) Filed: Sep. 11, 2008

(65) Prior Publication Data

US 2009/0287394 A1 Nov. 19, 2009

(30) Foreign Application Priority Data

May 16, 2008 (JP) ..... 2008-129777

(51) Int. Cl.
*F02D 41/16* (2006.01)
*F02D 45/00* (2006.01)

(52) U.S. Cl. ..... 701/103; 440/87; 123/339.22

(58) Field of Classification Search ..... 701/103, 701/102, 101; 123/339.16, 339.19, 339.22, 123/339.23, 352; 477/111; 440/87
See application file for complete search history.

(56) References Cited

U.S. PATENT DOCUMENTS 5,365,903 A * 11/1994 Watanabe ..... 123/339.22
5,375,574 A * 12/1994 Tomisawa et al. ..... 123/339.22
5,564,387 A * 10/1996 Igarashi et al. ..... 123/339.23
6,079,389 A 6/2000 Ono et al.

FOREIGN PATENT DOCUMENTS

JP 07-033797 B2 4/1995
JP 3860343 B2 9/2006

* cited by examiner

*Primary Examiner*—Hieu T Vo
(74) *Attorney, Agent, or Firm*—Sughrue Mion, PLLC

(57) ABSTRACT

There is provided an idling rotation speed control apparatus that can reduce the development man-hours and the cost and that enables operation during a trolling cruise to be readily performed. The idling rotation speed control apparatus includes an engine rotation speed detection means, an engine temperature detection means, an engine idling driving state detection means, an engine load detection means, an intake air amount adjusting means for adjusting an amount of intake air during an idling state, and an ECU for controlling the intake air amount adjusting means during idling driving. The ECU includes a basic torque ratio calculation function for calculating a ratio of torque to be generated, to engine maximal torque, that is necessary for making the engine steadily operate at a target rotation speed during idling driving; a target torque ratio calculation function for correcting the basic torque ratio, in accordance with a difference between a target rotation speed and an engine rotation speed, and calculating a target torque ratio; a target air amount calculation function for calculating an air amount necessary for generating the target torque ratio; and an intake air amount adjusting function for controlling the intake air amount adjusting means, based on the calculated air amount.

7 Claims, 12 Drawing Sheets

IDLING ROTATION SPEED CONTROL APPARATUS

BACKGROUND OF THE INVENTION

1. Field of the Invention

The present invention relates to an idling rotation speed control apparatus for controlling, when an internal combustion engine is idled, the rotation speed of the engine mounted on a ship or a boat.

2. Description of the Related Art

With regard to an electronically controlled engine, as disclosed, for example, in Japanese Patent Publication No. 1995-33797, an idling rotation speed control method has been proposed in which the amount of air supplied to the engine in an idling state is controlled so that the rotation speed of the engine is controlled to be a predetermined value. However, it is necessary for a small boat such as a motorboat or a fishing boat to perform a trolling cruise in which the boat cruises at a constant speed that is within a low-speed range close to an idling state; therefore, in general, it is necessary for a waterman to perform a minute throttle operation. In some cases, pitching or rolling (or both) of a boat makes it difficult to perform a minute throttle operation; accordingly, for example, Japanese Patent Laid-Open No. 1999-218046 has proposed a control device in which an external resistor is made to perform a function of adjusting the rotation speed of the engine during a trolling cruise so that the amount of air is controlled only during a trolling cruise.

In general, an idling rotation speed control apparatus for an engine performs data setting to make the amount of air match a load on the engine so that the engine is steadily driven at a target rotation speed, and controls the idling rotation speed by performing direct feedback of a supply air amount, based on the difference between the target rotation speed and an actual rotation speed.

The desired value of the idling rotation speed of an outboard engine changes depending on whether the shift-lever position is the neutral, forward, or backward position, as well as depending on the engine temperature. Additionally, in a trolling cruise characteristic of a boat or a ship, a waterman is required to maintain, through his operation, the engine rotation speed to be within a rotation-speed range of 600 to 1500 turns, when the shift-lever position is at the forward position; therefore, in general, the engine is driven through throttle lever operation by a waterman. Because a boat engine is utilized in such a trolling cruise as described above, the load imposed on the engine in an idling state largely changes and the target rotation speed differs, depending on a driving condition; therefore, in order to control the rotation speed by directly increasing or decreasing air amount data when the idling rotation speed of an outboard engine is controlled, the number of setting data pieces in an ECU (Electronic Control Unit) becomes large, and a great number of man-hours for matching are required.

Additionally, in the case where, when an idling control apparatus is developed, a setting change, in an ignition timing or the like, that leads to a change in the engine-torque output characteristics occurs, it is necessary to implement matching again, because the amount of air necessary for making the engine steadily operate at a target rotation speed changes. Additionally, also in the case where the rotation speed is controlled by feeding back an air amount in accordance with the difference between the target rotation speed and an actual rotation speed, the control program becomes extremely complicated, because setting of the feedback gain differs depending on the target rotation speed or the load imposed on the engine when the engine operates. Additionally, in the case where a specification such as an engine capacity differs, massive data is required for each engine.

As described above, in the case where a high-accuracy idling rotation speed control apparatus for an outboard engine is configured, massive man-hours are required and matching data cannot universally be utilized; therefore, setting has been required for each engine. Additionally, in order to lighten the boat-handling load imposed on a waterman during a trolling cruise, it is required that, while the trolling cruise is performed through an idling rotation speed control apparatus, the trolling rotation speed can more readily and accurately be set even though the setting is performed even on board a ship that is rolling and pitching.

SUMMARY OF THE INVENTION

The present invention has been implemented in order to solve the foregoing problems; the objective of the present invention is to provide an idling rotation speed control apparatus, for a boat, in which development man-hours and the cost can be reduced, waterman's operation during a trolling cruise can readily be performed, and the respective rotation speeds during an idling state with no load (a neutral state) and during an idling state with a load can be controlled so as to become target values.

An idling rotation speed control apparatus, for an outboard engine mounted on a boat, according to the present invention is characterized by including an engine-rotation-speed detection means for detecting a rotation speed of an engine; an engine-temperature detection means for detecting a warming-up state of the engine; an idling driving state detection means for detecting an idling driving state of the engine; a load detection means for detecting an engine load that changes depending on whether a shift-lever position of the engine is the neutral, the forward, or the backward position; an intake air amount adjusting means for adjusting an amount of intake air supplied to the engine during an idling state; and a control unit (ECU) for, while the engine is in an idling state, controlling the intake air amount adjusting means so as to make the engine rotation speed converge on a target rotation speed, based on an engine state detected by the detection means, and characterized in that the ECU includes a basic torque ratio calculation function for calculating a ratio of torque to be generated, to engine maximal torque, that is necessary for making the engine steadily operate at a target rotation speed during idling driving; a target torque ratio calculation function for correcting the basic torque ratio, in accordance with a difference between a target rotation speed and an engine rotation speed, and calculating a target torque ratio; a target air amount calculation function for calculating an air amount necessary for generating the target torque ratio; and an intake air amount adjusting function for controlling the intake air amount adjusting means, based on the calculated air amount.

According to the preset invention, while an engine is in an idling state, matching data can be set with a torque ratio, regardless of a shift-lever position and a trolling speed, and because, in calculating a supply air amount, differences in a target rotation speed, an ignition timing, an engine capacity, and the like are automatically compensated, matching setting can readily be performed. Moreover, the control logic can be simplified, the development man-hours can be reduced, and the matching data can universally be utilized in other engines. Still moreover, the load on a waterman during a trolling cruise can be reduced, the trolling rotation speed can accurately be controlled, and transition between a trolling state and a neutral state can be smoothened; therefore, there can be provided an idling rotation speed control apparatus, for a boat engine, that has a higher accuracy.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Figure 1:
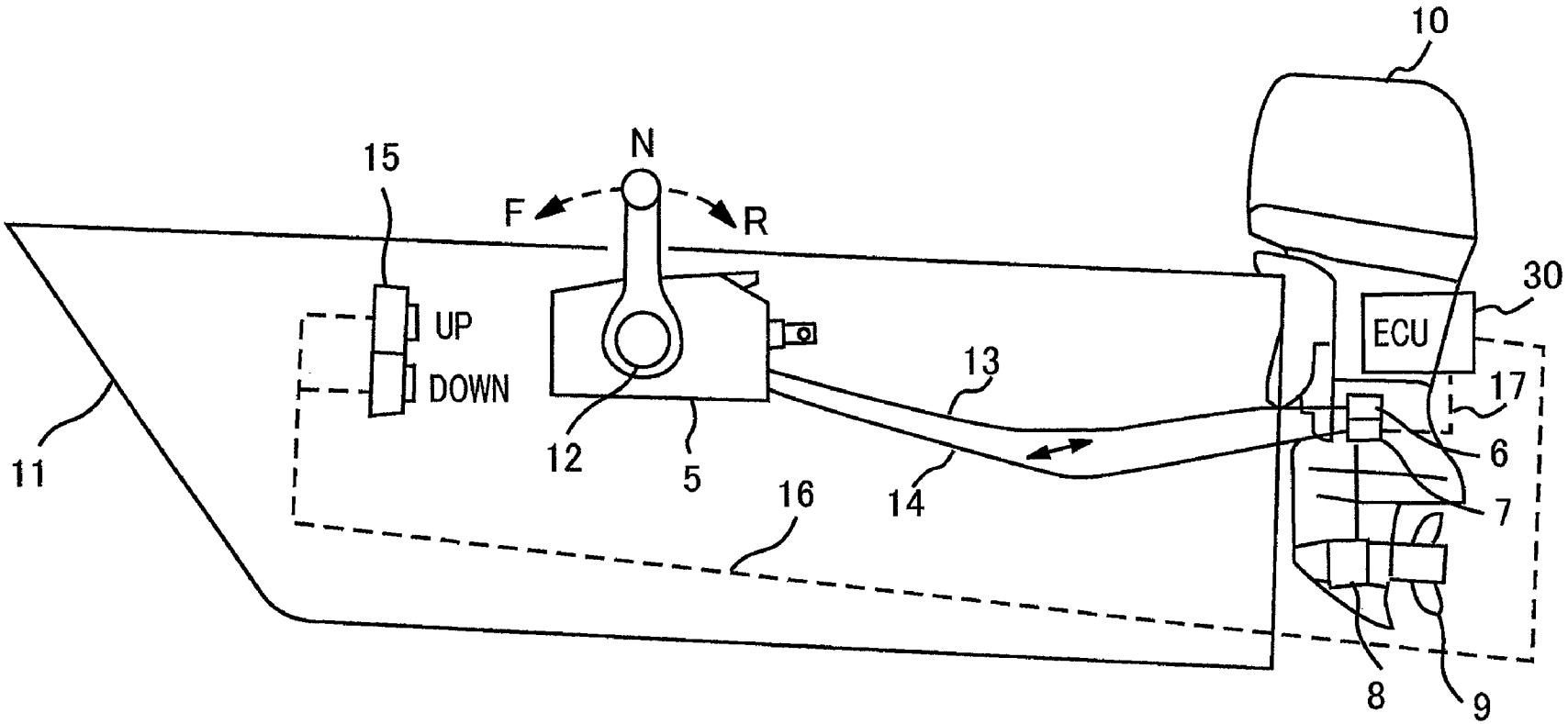
FIG. 1 is a schematic diagram illustrating a boat to which the present invention is applied.

In order to control the engine rotation speed during an idling state in such a way that the engine rotation speed becomes a target rotation speed, it is required to balance the engine torque with the engine load determined by the shift-lever position, the rotation speed during steady driving, and the like. Because engine torque increases or decreases depending on the amount of air taken in by an engine, the air amount with which the engine load and the engine torque balance with each other has directly been controlled through matching data or the like.

In an idling rotation speed control apparatus according to any one of aspects 1, 2, and 3 of the present invention, matching data is set and controlled based on not an air amount but torque generated by an engine, more specifically, based on the proportion of desired torque to the maximal torque (referred to as torque ratio, hereinafter) that can be generated by the engine. The torque required to steadily drive an engine at a predetermined rotation speed while the speed control lever is at a neutral position changes depending on the engine friction, and the engine friction is determined by the engine temperature and the rotation speed at which the engine is steadily driven.

Accordingly, matching map data created by utilizing as parameters the target rotation speed and the engine temperature is provided, and torque ratio data corresponding to the engine load is set in a matching manner in a memory inside the ECU. Because the required torque ratio differs also depending on the shift lever position, respective maps for required torque ratios are prepared for the neutral, forward, and backward positions, and a torque ratio required to perform map calculation is calculated based on the shift lever position, the engine temperature, and the target rotation speed, so that a basic torque ratio is calculated.

Additionally, in order to absorb the variations in engines and changes in the characteristics with time, feed-back correction is applied to the basic torque ratio in such a way that the difference between the target rotation speed and an actual rotation speed is cancelled, thereby calculating a target torque ratio, and then torque to be generated by the engine is calculated.

Next, in the case where the ignition timing for idling is set to a predetermined value, assuming that the target torque ratio is equal to the engine filling efficiency, the basic filling efficiency is obtained from the target torque ratio. Next, based on the actual engine ignition timing at this moment, the basic filling efficiency is corrected. The basic filling efficiency is corrected, through map data preliminarily set based on the difference between an actual ignition timing and the predetermined value, in such a way as to be reduced in the case where the ignition angle is advanced, or to be increased in the case where the ignition angle is delayed. By utilizing the target filling efficiency, an air amount to be supplied to the engine is calculated based on the target rotation speed, the engine capacity, and the air density, and by controlling an air intake amount adjusting means in such a way that the calculated air amount can be supplied, the rotation speed is controlled to be a target engine rotation speed.

An idling rotation speed control apparatus according to aspect 4 of the present invention is configured in such a way that a target rotation speed during idling is calculated by adding an adjustable rotation speed derived from a trolling speed setting means formed of an external rotation speed adjuster, i.e., a trolling switch to a basic target rotation speed calculated from the engine temperature. Accordingly, a waterman can freely set the engine rotation speed while the boat trolls, whereby operation of the throttle lever is not required.

An idling rotation speed control apparatus according to aspect 5 of the present invention is configured in such a way that the external setting of the adjustable rotation speed can be performed only in the case where the engine is in an idling state and the shift lever position is at the forward position. As a result, erroneous setting, caused by erroneous operation, of the adjustable rotation speed in driving states other than a trolling cruise can be prevented.

An idling rotation speed control apparatus according to aspect 6 of the present invention is configured in such a way that, when the shift lever position is changed from the forward to the neutral position, the external setting of the adjustable rotation speed is reset. As a result, when the shift lever position is at the neutral position, the rotation speed is automatically set to the basic target rotation speed; therefore, unnecessary increase in the rotation speed does not occur. Moreover, because the adjustable rotation speed is reset, the target rotation speed is low; therefore, even in the case where the shift lever position is changed again from the neutral to the forward position, a boat is prevented from abruptly starting.

In an idling rotation speed control apparatus according to aspect 7 of the present invention, the external setting of the adjustable rotation speed is performed by two switches, i.e., an upward switch and a downward switch so that setting of the rotation speed can readily and accurately be performed; additionally, an upper limit value or a lower limit value is provided for the setting value, so that extreme setting is suppressed.

Idling rotation speed control apparatuses according to the present invention will be explained below in a specific and detailed manner, with reference to the drawings.

Embodiment 1

FIG. 1 is a schematic diagram illustrating a boat to which the present invention is applied. An outboard engine 10 is a propulsion engine in which an internal combustion engine (referred to as an engine, hereinafter), a propeller shaft, a propeller, and the like are integrated; the outboard engine 10 is mounted at the stern of a boat 11. A remote controller 5, which is manipulated by a driver, is provided at the right side of the cockpit, and propulsive force and a propulsive direction can be set by use of a throttle lever 12. The throttle valve opening amount (TH) (intake air amount) is adjusted by use of the remote controller 5 via a throttle cable 13 and a throttle link mechanism 6 in the outboard engine 10. The shift-lever position (the neutral position N, the forward position F, or the backward position R) is set by use of the remote controller 5 via a shift cable 14 and a shift link mechanism 7 and a gear mechanism 8 that are disposed in the outboard engine 10. Information on the shift-lever position is transmitted to an ECU (Electronic Control Unit) 30 via a signal line 17. A trolling switch 15 is disposed in the vicinity of the cockpit. The trolling switch 15 is configured with two switches, i.e., an UP switch (to increase the rotation speed) and a DOWN switch (to decrease the rotation speed), and issues a rotation speed increase command or a rotation speed decrease command little by little each time the corresponding button is pressed. The output of the trolling switch 15 is transmitted to the ECU 30 via a signal line 16.

Figure 2:
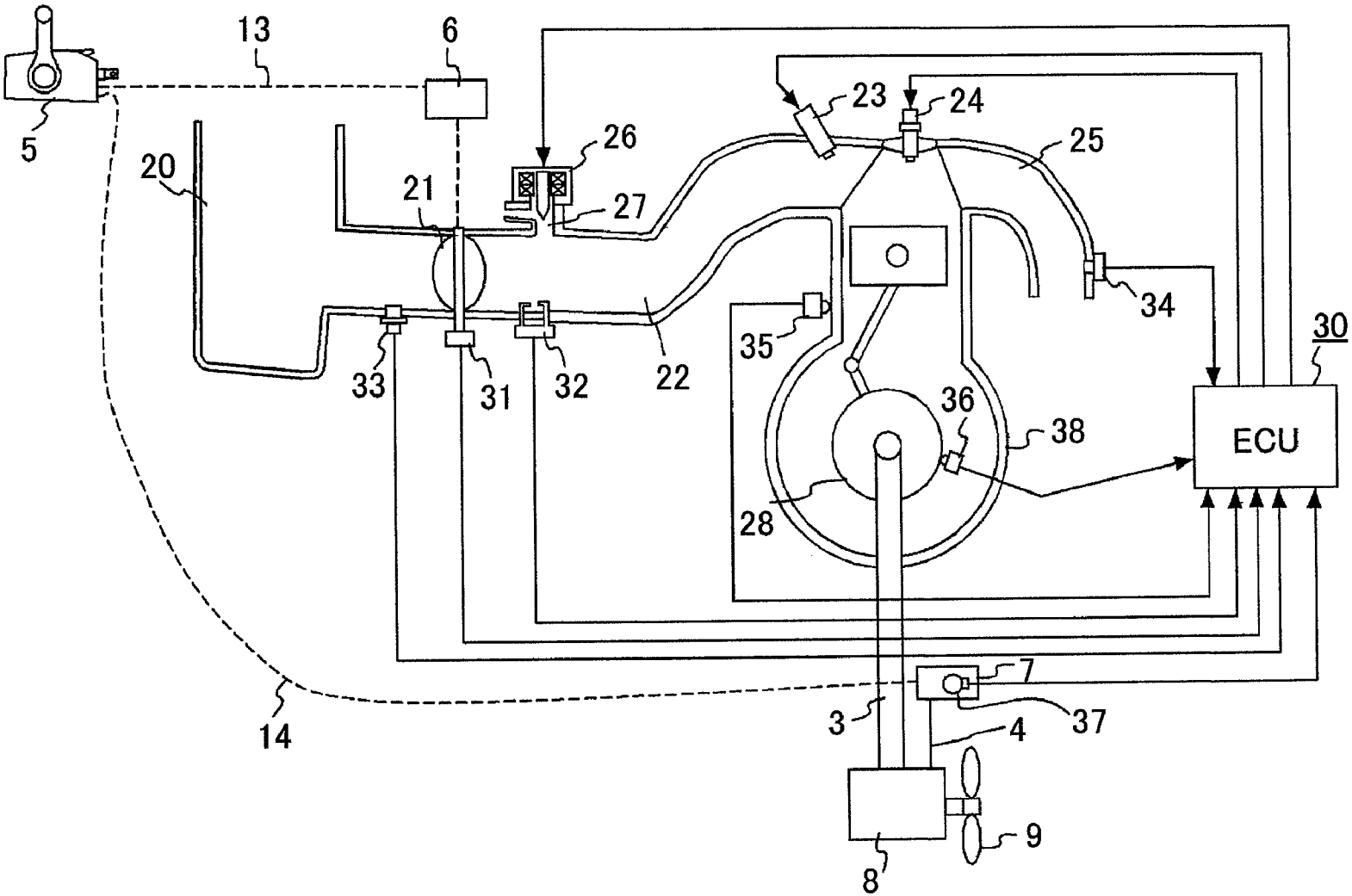
FIG. 2 is a schematic diagram illustrating an idling rotation speed control apparatus according to Embodiment 1 of the present invention.

FIG. 2 is a schematic diagram illustrating an engine mounted in the outboard engine 10. This engine takes in air through an air-intake pipe 20. While its flow rate is adjusted by a throttle valve 21, intake air flows through an intake manifold 22. Immediately before a combustion chamber in the intake manifold 22, there is disposed an injector 23 that injects a gasoline fuel. The intake air is mixed with the injected gasoline fuel so as to form a fuel-air mixture, flows into the combustion chamber of each cylinder, and is ignited by a spark plug 24 to combust. After the combustion, an exhaust gas flows through an exhaust manifold 25 so as to be discharged outside the engine.

An idling rotation speed control (referred to as an ISC, hereinafter) valve 26 for supplying air through another route is provided at the downstream side of the throttle valve 21. The ISC valve 26 is connected to the ECU 30, and driven based on an energization command value from the ECU 30 so as to adjust the opening degree of a branch route 27. A throttle opening degree sensor 31 is connected to the throttle valve 21, outputs a signal proportional to a throttle opening degree (TH) each time the shaft of the throttle valve rotates, and then transmits the signal to the ECU 30.

An absolute pressure sensor 32 is disposed at the downstream side of the throttle valve 21, and outputs a signal in accordance with an absolute pressure (PB) (engine load) inside the air-intake pipe. An intake air temperature sensor 33 is disposed at the upstream side of the throttle valve 21, and outputs a signal proportional to an intake air temperature (AT). An overheat sensor 34 is disposed on the exhaust manifold 25, and outputs a signal proportional to an engine exhaust gas temperature; a wall temperature sensor 35 is disposed at an appropriate position of a cylinder block 38 in the vicinity of the overheat sensor 34, and outputs a signal proportional to an engine cooling wall temperature (WT).

Propulsive force from the crankshaft is transferred to a propeller 9 via a drive shaft 3 and the gear mechanism 8. With the gear mechanism 8, switching among the neutral, forward, and backward positions can be performed; a selected position is transmitted from the remote controller 5 to the shift link mechanism 7 via the shift cable 14; the selection is performed by the shift link mechanism 7 via a shift rod 4. A shift-lever position sensor 37 is disposed in the vicinity of the shift link mechanism 7, and outputs a signal in accordance with a manipulated shift-lever position (SPS) (the neutral, the forward, or the backward position). The respective outputs of the various kinds of sensors are transmitted to the ECU 30 via corresponding signal lines. Additionally, a crank angle sensor 36 is disposed in the vicinity of a flywheel 28 mounted via the crankshaft, outputs a crank angle signal, and transmits the crank angle signal to the ECU 30. The ECU 30 calculates an engine rotation speed (NE) based on the output of the crank angle sensor 36.

Figure 3:
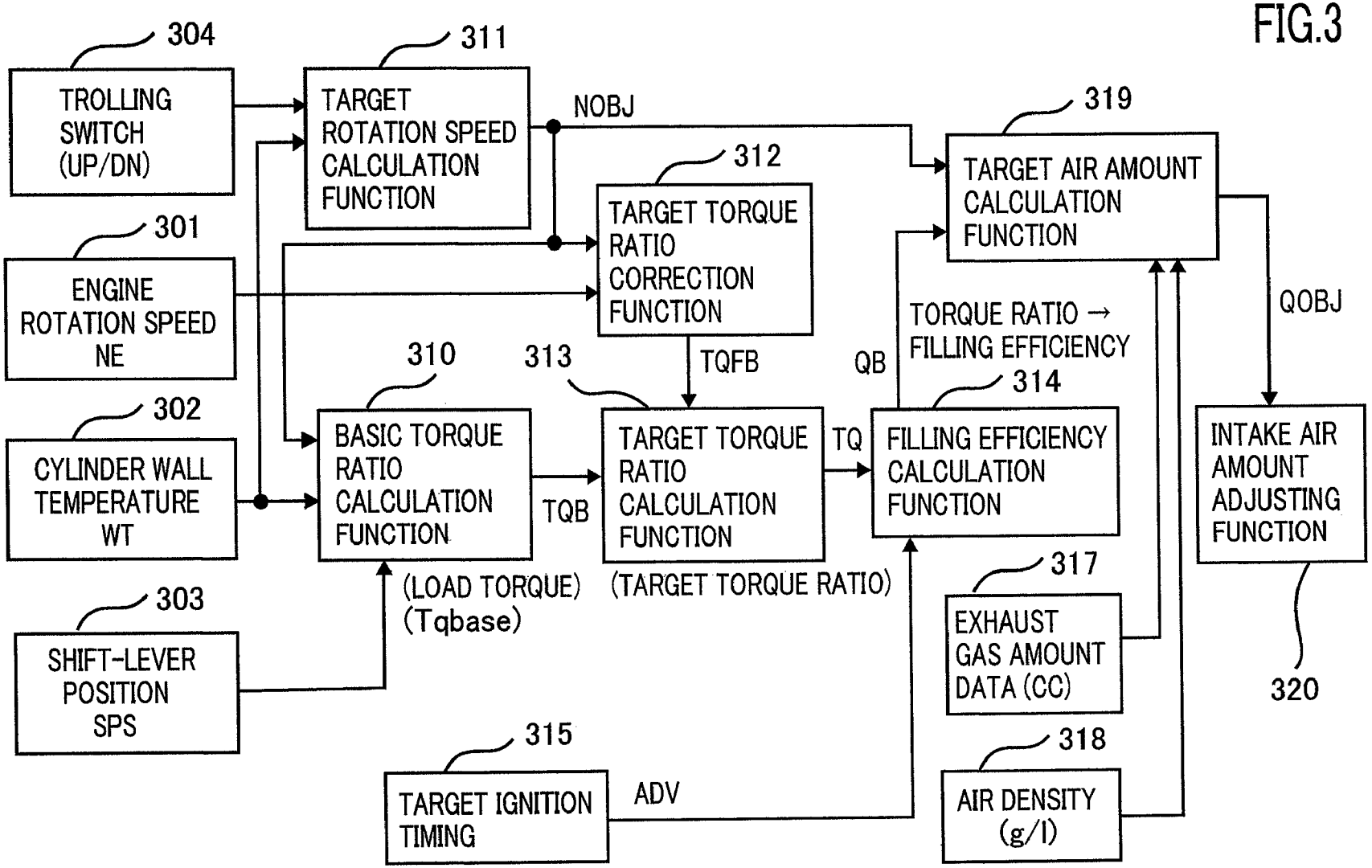
FIG. 3 is a block diagram illustrating the operation of an idling rotation speed control apparatus according to Embodiment 1.

Next, the operation of an idling rotation speed control apparatus according to Embodiment 1 will be explained. FIG. 3 is a block diagram representing the calculation function of the ECU 30. In FIG. 3, reference numeral 301 denotes the engine rotation speed (NE) calculated in the ECU 30, based on the output of the crank angle sensor 36; reference numeral 302 denotes the cylinder wall temperature (WT) obtained from the wall temperature sensor 35; reference numeral 303 denotes the shift-lever position (SPS); reference numeral 304 denotes the trolling switch position (UP or DOWN) of the trolling switch 15.

Reference numeral 310 denotes a basic torque ratio calculation function through which the basic torque ratio (TQB) is calculated based on the target rotation speed (NOBJ), the cylinder wall temperature (WT), and the shift-lever position (SPS). Reference numeral 311 denotes a target rotation speed calculation function through which the target rotation speed (NOBJ) is calculated based on the cylinder wall temperature (WT) and the trolling switch position (UP or DOWN). Reference numeral 312 denotes a target torque ratio correction function through which a target torque ratio correction amount (TQFB) is calculated based on the difference between the target rotation speed (NOBJ) and the engine rotation speed (NE). Reference numeral 313 denotes a target torque ratio calculation function through which the target torque ratio (TQ) is calculated based on the basic torque ratio (TQB) calculated through the basic torque ratio calculation function 310 and the target torque ratio correction amount (TQFB) calculated through the target torque ratio correction function 312.

Reference numeral 315 is a target ignition timing (ADV) calculated in the ECU 30 based on the various kinds of input values (NE, PB, TH, SPS, WT, AT, and the like). Reference numeral 314 denotes a filling efficiency calculation function through which the filling efficiency (QB) is calculated based on the target torque ratio (TQ) calculated through the target torque ratio calculation function 313 and target ignition timing (ADV) 315. Reference numeral 319 denotes a target air amount calculation function through which a target air amount (QOBJ) is calculated based on the filling efficiency (QB) calculated through the filling efficiency calculation function 314, the target rotation speed (NOBJ) calculated through the target rotation speed calculation function 311, a preliminarily set exhaust gas amount (XDISPLACE) as exhaust gas amount data 317, and a preliminarily set standard atmospheric density (XDENSITY) as air density 318. Reference numeral 320 denotes an intake air amount adjusting function through which the opening degree of the ISC valve 26 is set in such a way that the target air amount calculated through the target air amount calculation function 319 can be supplied to the engine. The foregoing functions will be explained below with reference to flowcharts.

(Basic Torque Ratio Calculation Function)

Figure 4:
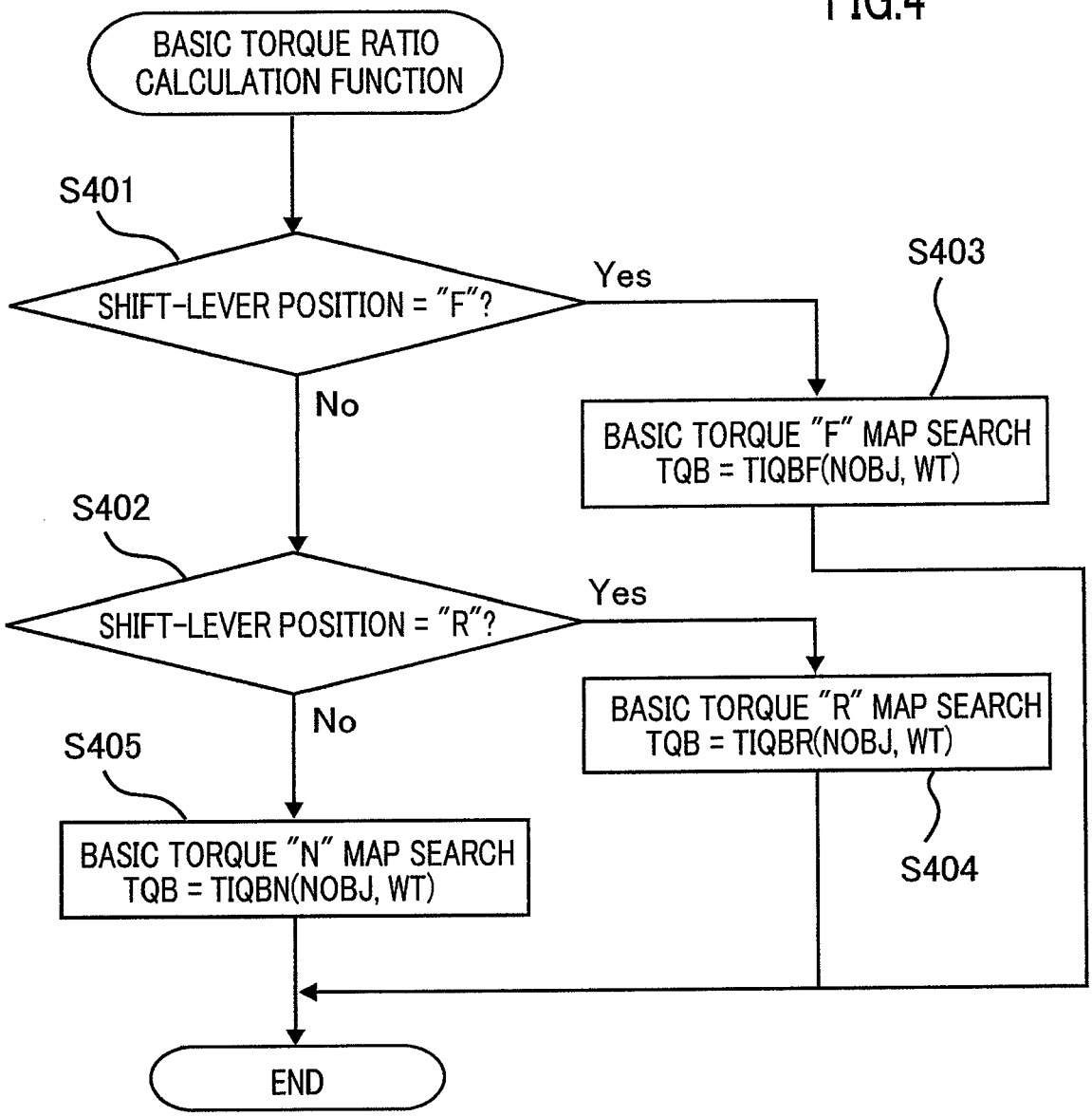
FIG. 4 is a flowchart representing a basic torque ratio (TQB) calculation function illustrated in FIG. 3.

FIG. 4 is a flowchart for setting the basic torque ratio (TQB) required to maintain the target rotation speed. In FIG. 4, in the case where it is determined in the step S401 that the position of the shift link mechanism corresponds to the shift-lever position "F" (forward), the basic torque "F" map TIQB (F) is searched so that the basic torque (TQB) is set. In the case where it is determined in the step S402 that the position of the shift link mechanism corresponds to the shift-lever position "R" (backward), the basic torque "R" map TIQB(R) is searched so that the basic torque (TQB) is set.

Figure 5:
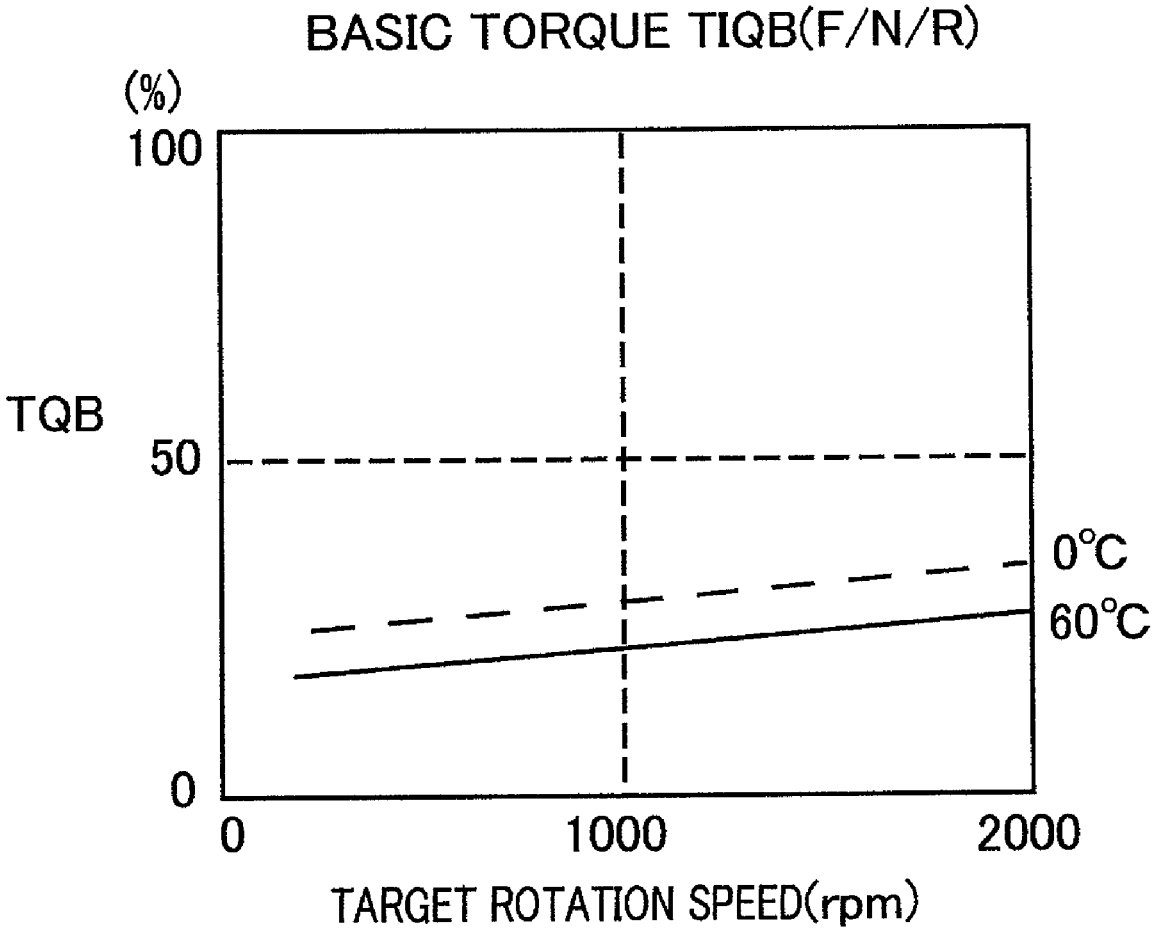
FIG. 5 is an explanatory graph representing the characteristics of a basic torque ratio map to be referred to in the flowchart in FIG. 4.

In the case where neither it is determined in the step S401 that the position of the shift link mechanism corresponds to the shift-lever position "F" (forward) nor it is determined in the step S402 that the position of the shift link mechanism corresponds to the shift-lever position "R" (backward), the shift-lever position is "N" (neutral); therefore, the basic torque "N" map TIQB(N) is searched so that the basic torque (TQB) is set. The basic torque maps TIQB(F), TIQB(R), and TIQB(N) are each configured, in a three-dimensional manner, with the basic torque ratio, the target rotation speed (NOBJ), and the cylinder wall temperature (WT). FIG. 5 is an explanatory graph representing the characteristics of each of the basic torque ratio maps TIQB(F), TIQB(R), and TIQB(N).

(Target Rotation Speed Calculation Function)

Figure 6:
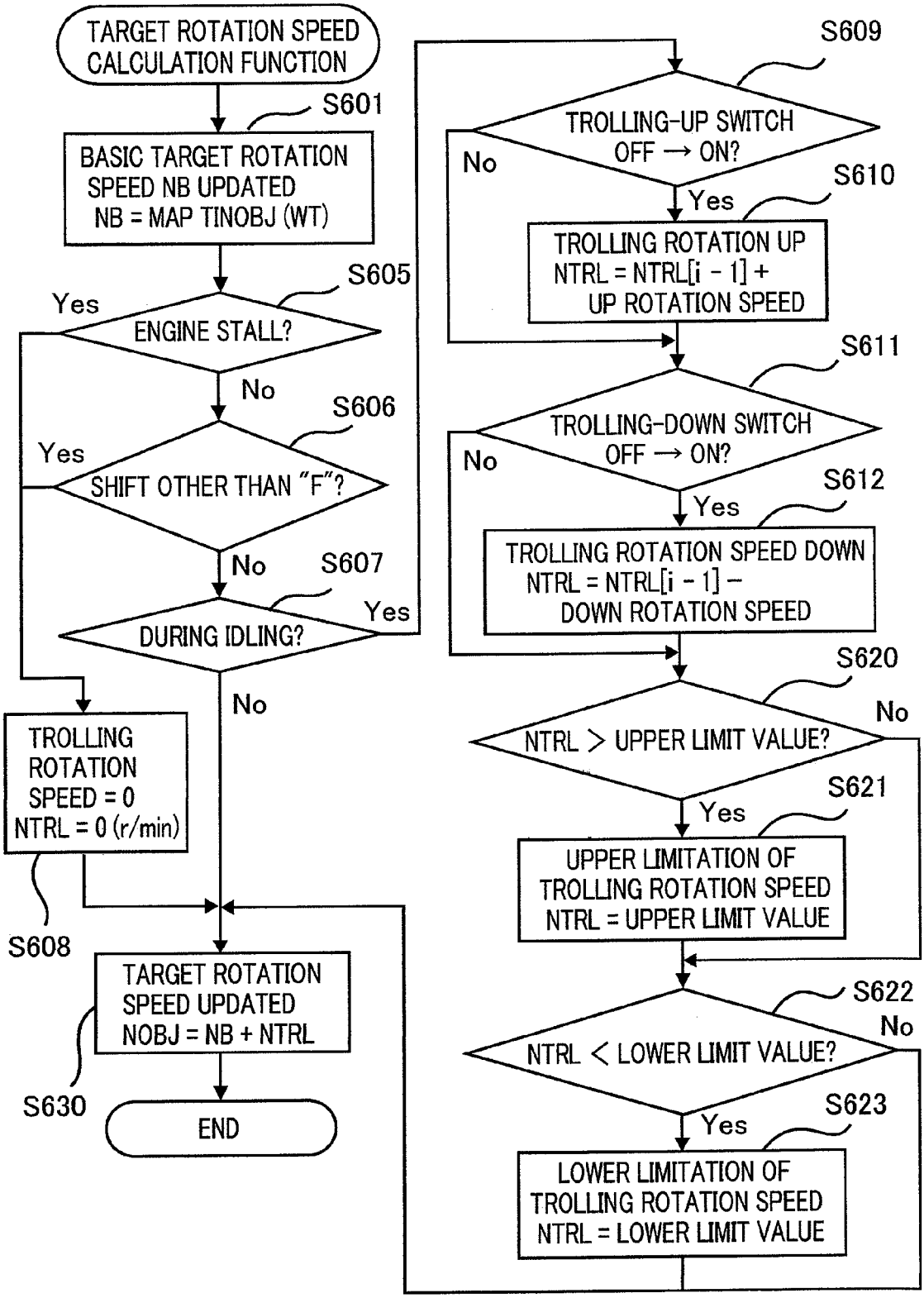
FIG. 6 is a flowchart representing a target rotation speed (NOBJ) calculation function illustrated in FIG. 3.
Figure 7:
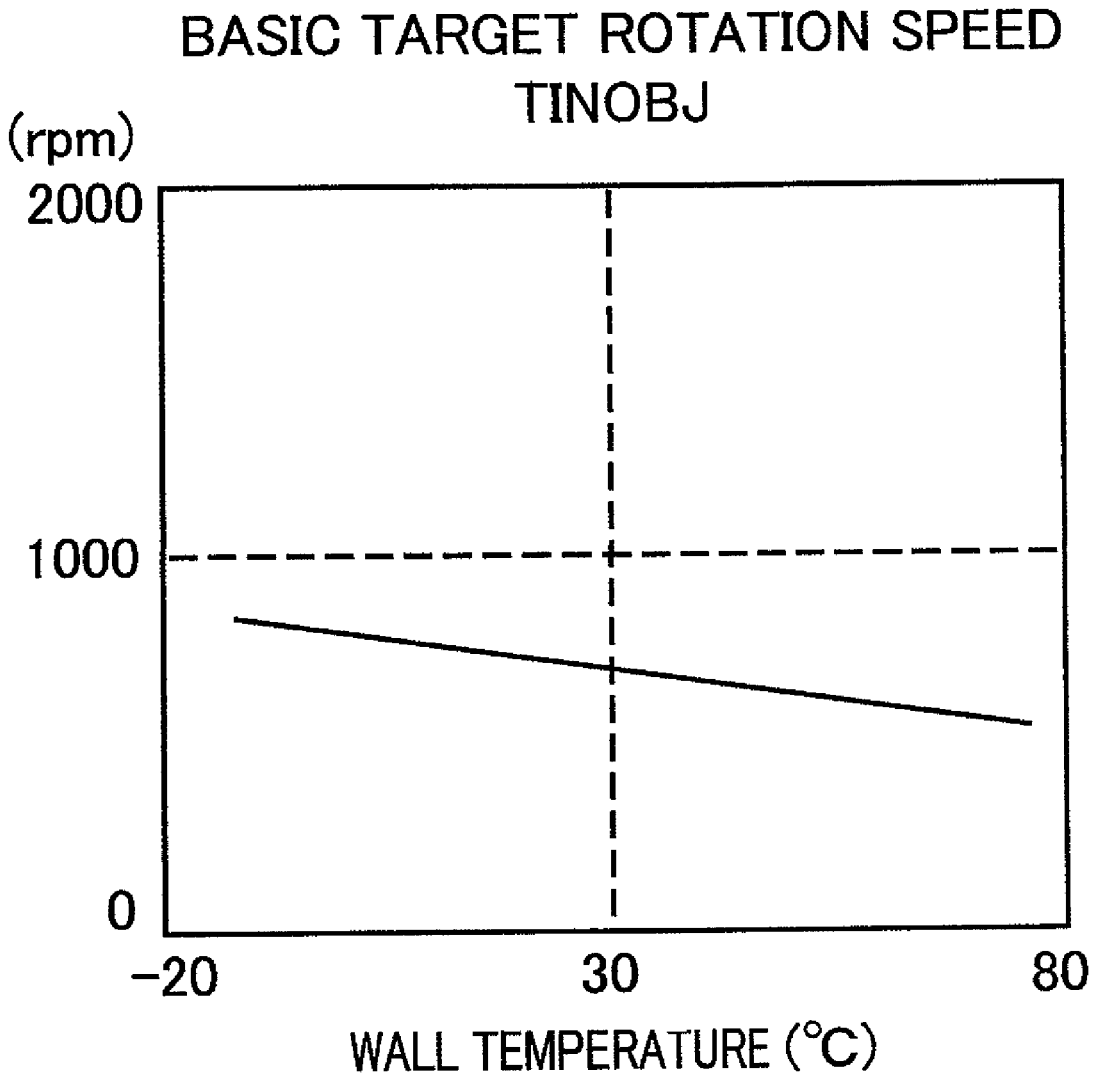
FIG. 7 is an explanatory graph representing the characteristics of a basic target rotation speed map to be referred to in the flowchart in FIG. 6.

FIG. 6 is a flowchart for setting the target rotation speed (NOBJ); FIG. 7 is an explanatory graph representing the characteristics of the basic target rotation speed map TINOBJ. In the step S601, the basic target rotation speed map TINOBJ is searched so that the basic target rotation speed (NB) is set. The basic target rotation speed map is configured, in a two-dimensional manner, with the basic target rotation speed and the cylinder wall temperature (WT). In the step S605, it is determined whether or not the present state is in an engine stall state; in the case where the present state is in an engine stall state, the trolling rotation speed (NTRL) is set to zero (reset) in the step S608. In the step S606, it is determined to which shift-lever position the shift link mechanism corresponds; in the case where the shift link mechanism corresponds to a shift-lever position (i.e., either the backward "R" or the neutral "N") other than "F", the trolling rotation speed (NTRL) is set to zero (reset) in the step S608.

In the step S607, it is determined, based on the output of the throttle opening degree sensor 31, whether or not the present state is in an engine stall state; in the case where the present state is in an engine stall state, the trolling-UP switch is turned on in the step S609. In the case where it is determined in the step S607 that the present state is not in an engine stall state, the immediately previous value of the target trolling rotation speed (NTRL) is maintained. When the trolling-UP switch is turned on in the step S609, the trolling rotation speed (NTRL) is obtained in the step S610, by adding the setting value (XTRLSTEP1), for the adjustable rotation speed, set through the trolling switch 15 to the immediately previous value (NTRL[i−1]) of the trolling rotation speed (NTRL). When the trolling-DOWN switch is turned on in the step S611, the trolling rotation speed (NTRL) is obtained in the step S612, by subtracting the setting value (XTRLSTEP2), for the adjustable rotation speed, set through the trolling switch 15 from the immediately previous value (NTRL[i−2]) of the trolling rotation speed (NTRL).

It is determined in the step S620 whether or not the trolling rotation speed (NTRL) set in such a way as described above exceeds an upper limit value (XTRLMAX); in the case where the trolling rotation speed (NTRL) exceeds the upper limit value (XTRLMAX), the trolling rotation speed (NTRL) is fixed to the upper limit value (XTRLMAX) in the step S621. It is determined in the step S622 whether or not the trolling rotation speed (NTRL) set in such a way as described above is lower than a lower limit value (XTRLMIN); in the case where the trolling rotation speed (NTRL) is lower than the lower limit value (XTRLMIN), the trolling rotation speed (NTRL) is fixed to the lower limit value (XTRLMIN) in the step S623. In the step S630, the target rotation speed (NOBJ) is obtained by adding the basic target rotation speed (NB) set in such a way as described above and the trolling rotation speed (NTRL), i.e., the adjustable rotation speed set through the trolling switch 15.

(Target Torque Ratio Correction Function)

Figure 8:
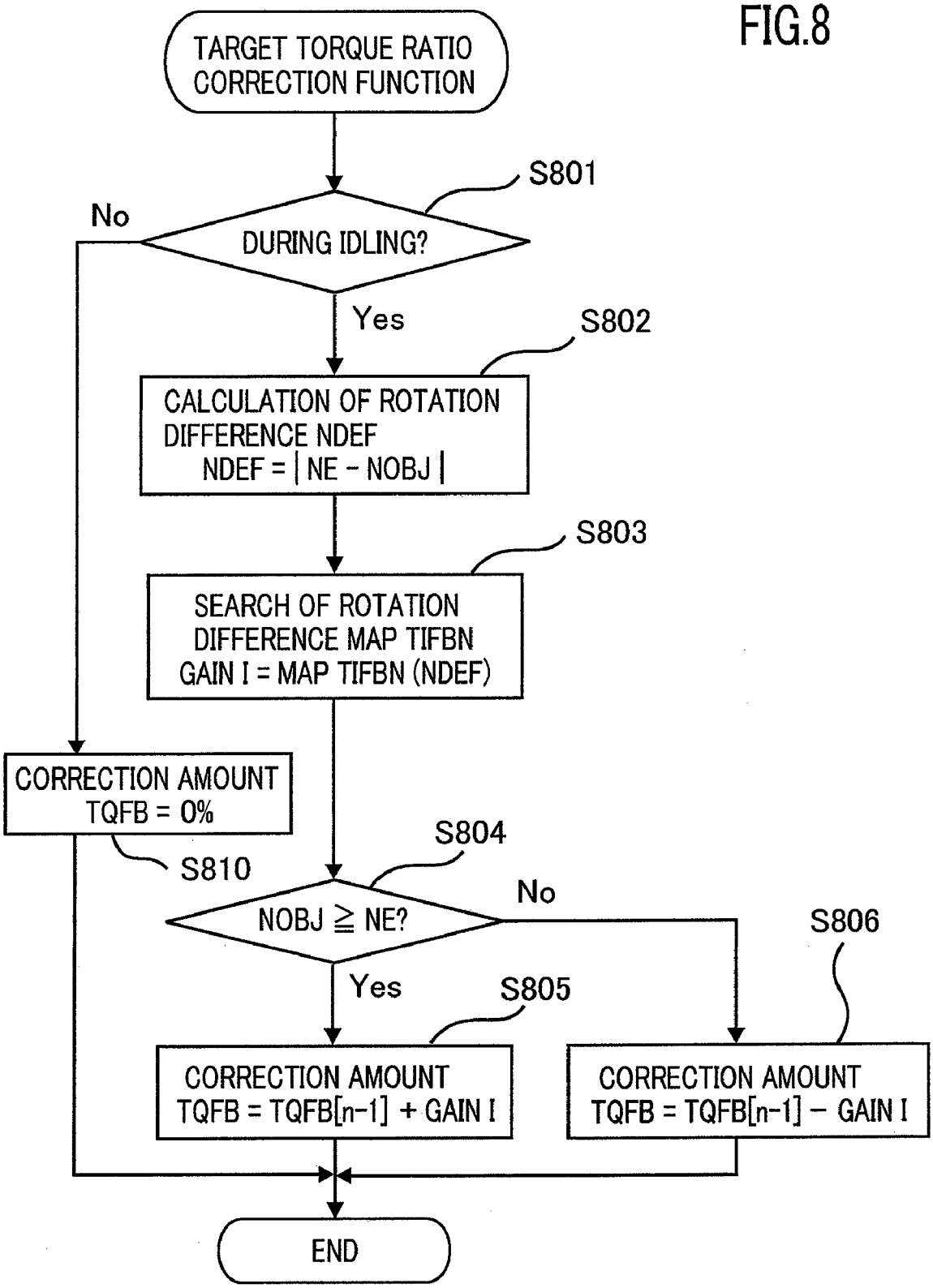
FIG. 8 is a flowchart representing a basic torque ratio correction amount (TQFB) calculation function illustrated in FIG. 3.
Figure 9:
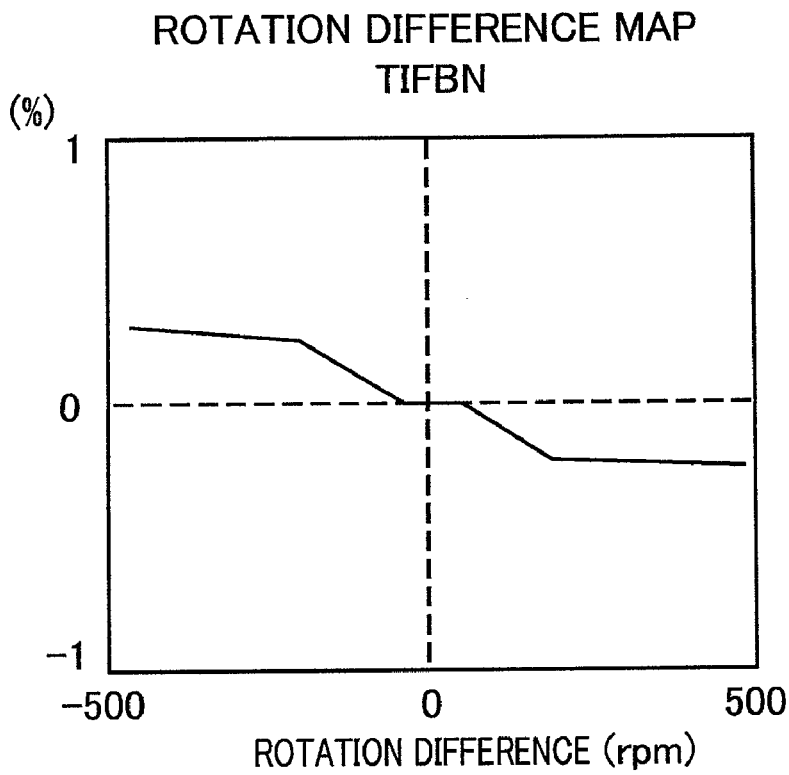
FIG. 9 is an explanatory graph representing the characteristics of a rotation speed difference map to be referred to in the flowchart in FIG. 8.

FIG. 8 is a flowchart for setting the target torque ratio correction function; FIG. 9 is an explanatory graph representing the characteristics of a rotation difference map TIFBN. In the step S801, it is determined, based on the output of the throttle opening degree sensor 31, whether or not the present state is in an engine stall state; in the case where the present state is in an engine stall state, the step S802 is performed. In the case where the present state is not in an engine stall state, the target torque ratio correction amount (TQFB) is set to zero percent (reset) in the step S810. In the step S802, a rotation difference (NDEF) between the target rotation speed (NOBJ) and the rotation speed (NE) is calculated. In the step S803, the rotation difference map TIFBN is searched so that a correction gain (I) is set. The rotation difference map TIFBN is configured, in a two-dimensional manner, with the rotation difference and the rotor speed difference (NDEF).

In the step S804, the target rotation speed (NOBJ) is compared with the rotation speed (NE); in the case where the rotation speed (NE) is lower than the target rotation speed (NOBJ), the step S805 is performed. In the case where the rotation speed (NE) is higher than the target rotation speed (NOBJ), the step S806 is performed. In the step S805, the target torque ratio correction amount (TQFB) is obtained by adding the correction gain (I) to the immediately previous value TQFB[n−1] of the target torque ratio correction amount (TQFB). In the step S806, the target torque ratio correction amount (TQFB) is obtained by subtracting the correction gain (I) from the immediately previous value TQFB[n−1] of the target torque ratio correction amount (TQFB).

(Target Torque Ratio Calculation Function)

Figure 10:
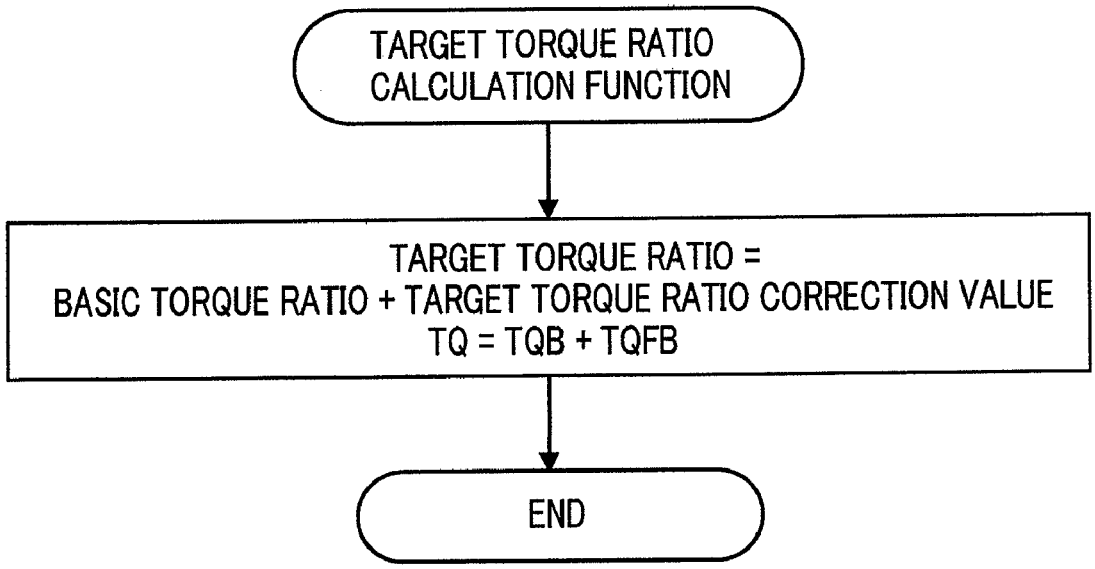
FIG. 10 is a flowchart representing a target torque ratio (TQ) calculation function illustrated in FIG. 3.

FIG. 10 is a flowchart for explaining the target torque ratio calculation function. In the step S101, the target torque ratio (TQ) is obtained by adding the basic torque ratio (TQB) calculated in such a way as described above and the target torque ratio correction amount (TQFB).

(Filling Efficiency Calculation Function)

Figure 11:
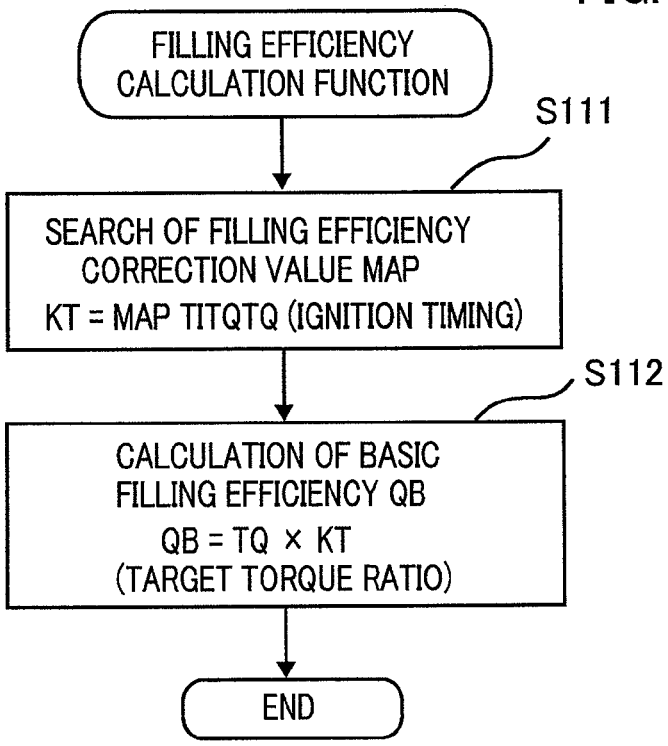
FIG. 11 is a flowchart representing a filling efficiency (QB) calculation function illustrated in FIG. 3.
Figure 12:
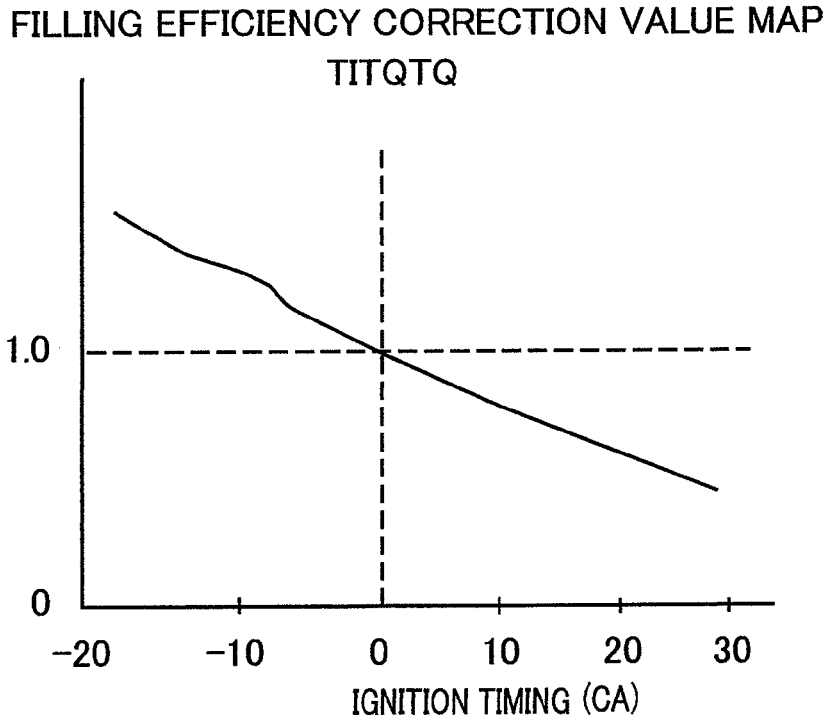
FIG. 12 is an explanatory graph representing the characteristics of a filling efficiency correction map to be referred to in the flowchart in FIG. 11.

FIG. 11 is a flowchart for explaining the filling efficiency calculation function of setting the filling efficiency. In the step S111, a filling efficiency correction map TITQTQ is searched so that a correction gain (KT) is set. The filling efficiency correction map TITQTQ is configured, in a two-dimensional manner, with the filling efficiency correction value and the target ignition timing (ADV). In the step S112, the filling efficiency (QB) is calculated by multiplying the target torque ratio (TQ) calculated in such a way as described above by the filling efficiency correction gain (KT). FIG. 12 is an explanatory graph representing the characteristics of the filling efficiency correction map TITQTQ. Assuming that the target ignition timing (0 CA, for example) during an idling state is the reference (1.0), the correction value is set in such a way that the filling efficiency is kept constant as the ignition timing changes. In normal cases (in the case where the AF value is constant), the torque increases as the ignition timing advances; therefore, in order to keep the filling efficiency constant, the correction value is set to a value smaller than the reference value. In contrast, the torque decreases as the ignition timing is delayed; therefore, in order to keep the filling efficiency constant, the correction value is set to a value larger than the reference value. The AF value denotes an air-fuel ratio that is a value obtained by dividing the mass of air in the fuel-air mixture by the mass of the fuel. In the case of a gasoline engine, the AF value is 14.7 at which the oxygen in the air and the fuel react with each other neither too much nor too little; the air-fuel ratio in this situation is referred to as a theoretical air-fuel ratio. In gasoline engines these days, a three-way catalyst is utilized for purifying exhaust gas; in order to make the three-way catalyst function effectively, it is required to make the fuel-air mixture combust at an air-fuel ratio close to the theoretical air-fuel ratio. The state in which the air-fuel ratio of a fuel-air mixture is higher than the theoretical air-fuel ratio is referred to as a rich fuel-air mixture; the state in which the air-fuel ratio of a fuel-air mixture is lower than the theoretical air-fuel ratio is referred to as a lean fuel-air mixture. A theoretical air-fuel ratio is referred to also as a stoichiometric air-fuel ratio.

(Target Air Amount Calculation Function)

Figure 13:
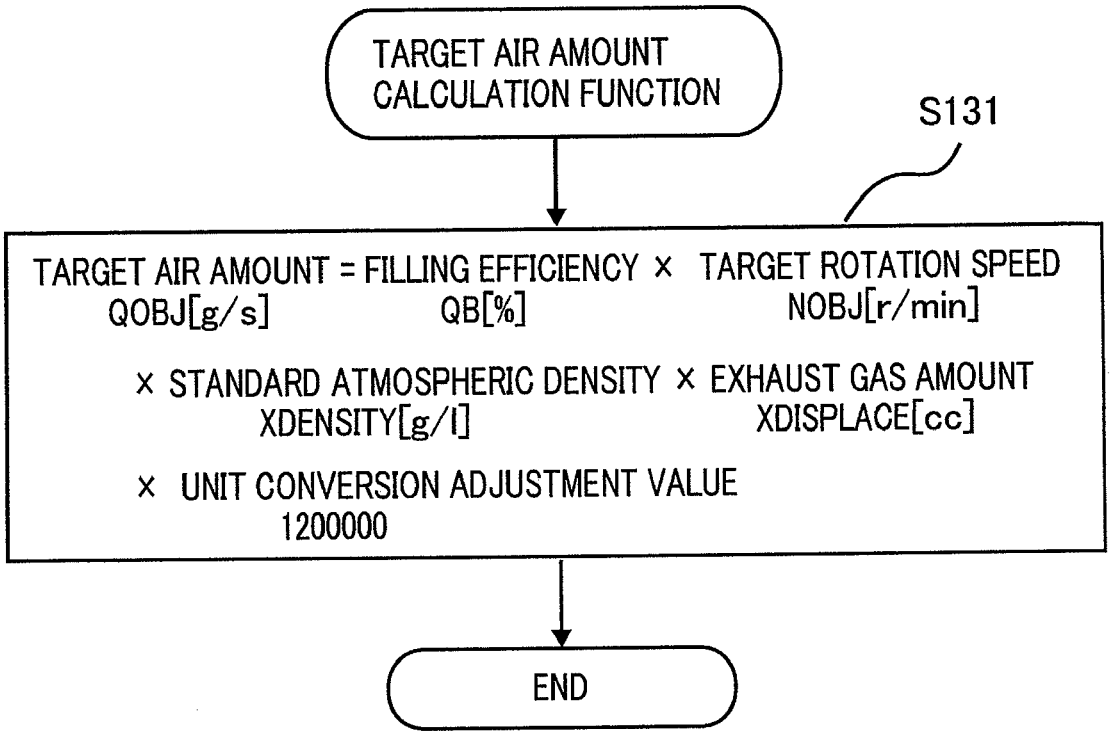
FIG. 13 is a flowchart representing a target air amount (QOBJ) calculation function illustrated in FIG. 3.

FIG. 13 is a flowchart for setting the target air amount calculation function. In the step S131, the target air amount (QOBJ) [g/s] is calculated by multiplying together the filling efficiency (QB) [%], the target rotation speed (NOBJ) [r/min], the standard atmospheric density [g/l], the exhaust gas amount [cc], and the unit conversion adjustment value 1200000.

(Intake Air Amount Adjusting Function)

Figure 14:
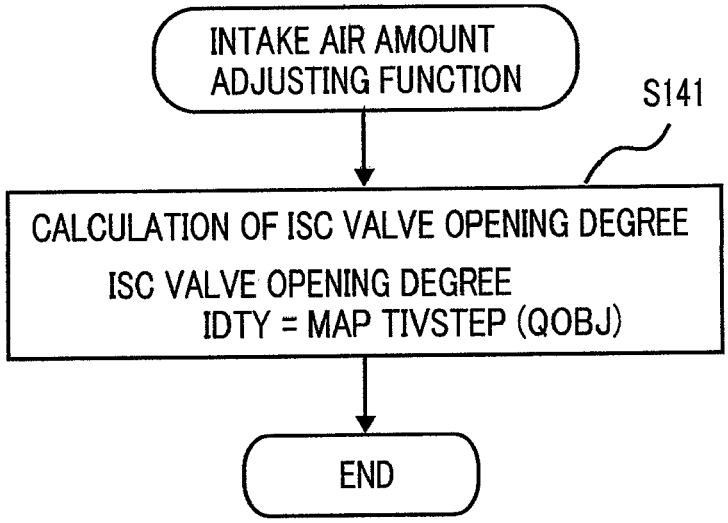
FIG. 14 is a flowchart representing an air intake amount (IDTY) calculation function illustrated in FIG. 3.
Figure 15:
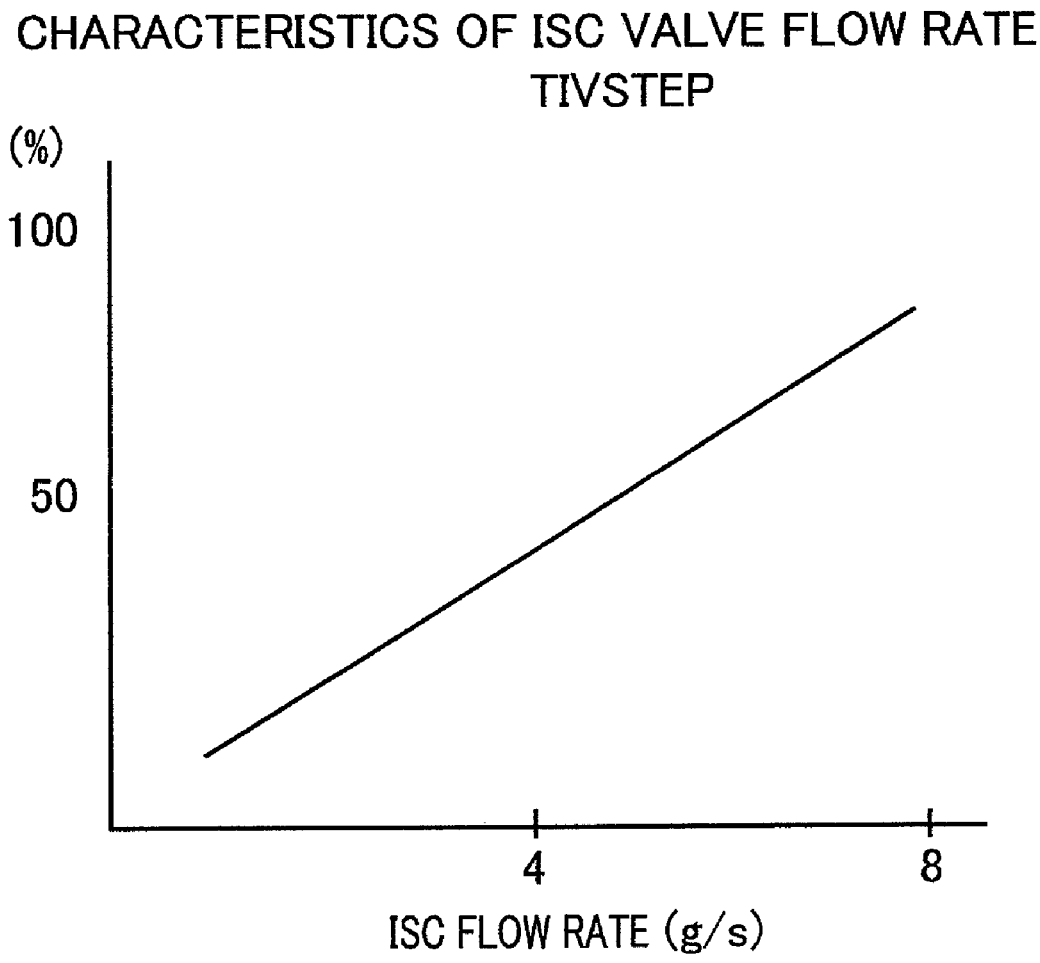
FIG. 15 is an explanatory graph representing the characteristics of an ISC valve flow rate characteristic map to be referred to in the flowchart in FIG. 14.

FIG. 14 is a flowchart for explaining the intake air amount adjusting function of setting the intake air amount (IDTY). In the step S141, the opening degree of the ISC valve 26 is calculated based on an ISC valve flow rate characteristic map TIVSTEP and the target air amount (QOBJ). The ISC valve flow rate characteristic map TIVSTEP is configured, in a two-dimensional manner, with the ISC valve flow rate and the target air amount (QOBJ). FIG. 15 is an explanatory graph representing the characteristics of the ISC valve flow rate characteristic map TIVSTEP. In the map, the ISC valve opening degree corresponding to the intake air amount [g/s] is preliminarily set. In addition, the intake air amount adjusting function is not limited to a configuration in which, as Embodiment 1, the throttle valve 21 is bypassed by utilizing the ISC valve 26; a configuration utilizing an electronic throttle actuator having an idling control function is also effective.

Various modifications and alterations of this invention will be apparent to those skilled in the art without departing from the scope and spirit of this invention, and it should be understood that this is not limited to the illustrative embodiments set forth herein.

What is claimed is:

1. An idling rotation speed control apparatus, for an outboard engine mounted on a boat, comprising:

an engine-rotation-speed detection means for detecting a rotation speed of an engine;

an engine-temperature detection means for detecting a warming-up state of the engine;

an idling driving state detection means for detecting an idling driving state of the engine;

a load detection means for detecting an engine load that changes depending on whether a shift-lever position of the engine is the neutral, the forward, or the backward position;

an intake air amount adjusting means for adjusting an amount of intake air supplied to the engine during an idling state; and a control unit (ECU) for, while the engine is in an idling state, controlling the intake air amount adjusting means so as to make the engine rotation speed converge on a target rotation speed, based on an engine state detected by the detection means, wherein the ECU includes a basic torque ratio calculation function for calculating a ratio of torque to be generated, to engine maximal torque, that is necessary for making the engine steadily operate at a target rotation speed during idling driving;

a target torque ratio calculation function for correcting the basic torque ratio, in accordance with a difference between a target rotation speed and an engine rotation speed, and calculating a target torque ratio;

a target air amount calculation function for calculating an air amount necessary for generating the target torque ratio; and an intake air amount adjusting function for controlling the intake air amount adjusting means, based on the calculated air amount.

2. The idling rotation speed control apparatus according to claim 1, wherein a basic torque ratio necessary for making the engine steadily operate at the target rotation speed is one of map data pieces that are each represented as a ratio of torque to the engine maximal torque and preliminarily set in an internal memory of the ECU, and based on the value of the map data piece, the basic torque ratio is calculated from a target rotation speed, an engine temperature, and a shift-lever position.

3. The idling rotation speed control apparatus according to claim 1, wherein, in calculating an air amount, based on a target torque ratio necessary for making the engine steadily operate at the target rotation speed, a basic filling efficiency is calculated with respect to a predetermined ignition timing; an engine ignition timing is detected; in the case where the ignition timing is delayed, the basic filling efficiency is corrected so as to be increased, and in the case where ignition timing is advanced, the basic filling efficiency is corrected so as to be decreased, so that a target filling efficiency is calculated; and the air amount is calculated based on the target filling efficiency.

4. The idling rotation speed control apparatus according to claim 1, wherein the target rotation speed during an idling state is calculated by adding a basic target rotation speed calculated from an engine temperature and an adjustable rotation speed set manually through an external switch.

5. The idling rotation speed control apparatus according to claim 4, wherein the adjustable rotation speed can be adjusted through the external switch only in the case where the shift-lever position is the forward position and the engine is in an idling state.

6. The idling rotation speed control apparatus according to claim 4, wherein a value that has been set for the adjustable rotation speed is reset in the case where the shift-lever position changes from the forward position to the neutral position.

7. The idling rotation speed control apparatus according to claim 4, wherein the external switch includes an UP switch for increasing the adjustable rotation speed and a DOWN switch for decreasing the adjustable rotation speed; by pressing the UP switch or the DOWN switch, the adjustable rotation speed can be increased or decreased little by little, respectively; and the adjustable rotation speed is upper-limited or lower-limited to a predetermined rotation speed.

* * * * *